US011448044B2

(12) United States Patent
Dyess et al.

(10) Patent No.: US 11,448,044 B2
(45) Date of Patent: Sep. 20, 2022

(54) UNIVERSAL PLUG AND PLAY PERFORATING GUN TANDEM

(71) Applicant: Hunting Titan, Inc., Pampa, TX (US)

(72) Inventors: Adam Dyess, Houston, TX (US); Jason Hoang Mai, Houston, TX (US); Richard Wayne Bradley, Magnolia, TX (US); Joshua Blake Howk, Kingwood, TX (US)

(73) Assignee: Hunting Titan, Inc., Pampa, TX (US)

( * ) Notice: Subject to any disclaimer, the term of this patent is extended or adjusted under 35 U.S.C. 154(b) by 4 days.

(21) Appl. No.: 17/059,992

(22) PCT Filed: Nov. 27, 2019

(86) PCT No.: PCT/US2019/063584

§ 371 (c)(1),
(2) Date: Nov. 30, 2020

(87) PCT Pub. No.: WO2020/112983

PCT Pub. Date: Jun. 4, 2020

(65) Prior Publication Data

US 2021/0222525 A1 Jul. 22, 2021

Related U.S. Application Data

(60) Provisional application No. 62/773,044, filed on Nov. 29, 2018.

(51) Int. Cl.

| | |
|---|---|
| ***E21B 43/1185*** | (2006.01) |
| ***E21B 43/119*** | (2006.01) |
| ***F42B 3/103*** | (2006.01) |
| ***F42D 1/05*** | (2006.01) |

(52) U.S. Cl.
CPC ..... *E21B 43/1185* (2013.01); *E21B 43/119* (2013.01); *F42B 3/103* (2013.01); *F42D 1/05* (2013.01)

(58) Field of Classification Search
CPC ..... E21B 43/1185; E21B 43/119; F42B 1/02; F42B 3/02; F42B 3/10; F42B 3/103; F42C 11/001; F42C 19/06; F42D 1/045; F42D 1/05
See application file for complete search history.

(56) References Cited

U.S. PATENT DOCUMENTS

| | | | | |
|---|---|---|---|---|
| 2012/0247769 | A1 | 10/2012 | Schacherer et al. | |
| 2013/0008639 | A1 | 1/2013 | Tassaroli | |
| 2017/0211363 | A1 | 7/2017 | Bradley et al. | |
| 2017/0370194 | A1* | 12/2017 | Hernandez Lopez | E21B 33/12 |
| 2019/0292887 | A1* | 9/2019 | Austin, II | E21B 43/117 |
| 2020/0256168 | A1* | 8/2020 | Knight | E21B 43/117 |
| 2021/0222525 | A1* | 7/2021 | Dyess | F42B 3/10 |

FOREIGN PATENT DOCUMENTS

| | | | |
|---|---|---|---|
| WO | 2018030996 | A1 | 2/2018 |
| WO | 2018057934 | A1 | 3/2018 |

OTHER PUBLICATIONS

Notification of Transmittal of the International Search Report and the Written Opinion of the International Searching Authority, PCT Application No. PCT/US19/63584, dated Jan. 22, 2020, 8 pages.

* cited by examiner

*Primary Examiner* — Daniel P Stephenson

(57) ABSTRACT

A method and apparatus for providing a universal plug in cartridge detonator capability in box-by-box perforating guns.

25 Claims, 5 Drawing Sheets

UNIVERSAL PLUG AND PLAY PERFORATING GUN TANDEM

RELATED APPLICATIONS

This application claims priority to U.S. Provisional Application No. 62/773,044, filed Nov. 29, 2018.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically, a wellbore will be drilled from a surface location, placing a hole into a formation of interest. Completion equipment will be put into place, including casing, tubing, and other downhole equipment as needed. Perforating the casing and the formation with a perforating gun is a well-known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Electric initiators are commonly used in the oil and gas industry for initiating different energetic devices down hole. Most commonly, 50-ohm resistor initiators are used. Other initiators and electronic switch configurations are common.

SUMMARY OF EXAMPLE EMBODIMENTS

An example embodiment may include a tandem sub for connecting one or more perforating guns comprising a cylindrical body with a first end, a second end, and a hollow inner bore, wherein the first end is a pinned end adapted to couple to a box end of a First perforating gun housing, wherein the second end is a pinned end adapted to couple to a box end of a second perforating gun housing, wherein the inner bore is adapted to contain a plug and play cartridge detonator assembly that can detonate a detonating cord upon receiving an electrical command from a wire.

A variation of the example embodiment may include the tandem sub further comprising a cartridge detonator assembly disposed within the hollow inner bore, the cartridge detonator further comprising a cylindrical body housing an electrical switch and circuit board, a distal end having a detonator, and a contact spring for electrically coupling the detonator assembly to a signal wire. It may include a feed thru puck coupled to a feed thru body, disposed within the hollow inner core. It may include the feed thru puck having a thru hole for an electrical wire. The feed thru body may have a means for coupling the electrical wire to the puck, thereby electrically coupling the electrical wire with the feed thru body. The contact spring may be coupled to the feed thru body. The feed thru body may have a hollow thru bore adapted for containing a booster and the detonator adjacent to each other. The means for electrically coupling the electrical wire with the feed thru body may be a radial wire groove on the feed thru body that an exposed end of the wire is wrapped around. The means for electrically coupling the electrical wire with the feed thru body may be a tangential thru hole that an exposed end of the wire is wrapped through and around. The means for electrically coupling the electrical wire with the feed thru body may be a metal screw that clamps an exposed end of the wire against a metal insert that is further coupled to the contact spring.

An example embodiment further may include a perforating gun string comprising a first perforating gun with an uphole box end, a downhole box end, a plurality of shaped charges connected together with a detonating cord, and a wire disposed therein, traveling from the uphole end to the downhole end, a first tandem sub for connecting one or more perforating guns coupled to the downhole end of the first perforating gun further comprising a cylindrical body with a first end, a second end, and a hollow inner bore, wherein the first end is a pinned end adapted to couple to a box end of the first perforating gun housing, wherein the second end is a pinned end adapted to couple to a box end of a second perforating gun housing, and wherein the inner bore is adapted to contain a plug and play cartridge detonator assembly that can detonate the detonating cord of the first perforating gun upon receiving an electrical command from the wire.

A variation of the example embodiment may include the tandem sub having a cartridge detonator assembly disposed within the hollow inner bore, the cartridge detonator further comprising a cylindrical body housing, an electrical switch and circuit board, a distal end having a detonator, and a contact spring for electrically coupling the detonator assembly to a signal wire. It may include a feed thru puck coupled to a feed thru body, disposed within the hollow inner core. The feed thru puck may have a thru hole for an electrical wire. The feed thru body may have a means for coupling the electrical wire to the puck, thereby electrically coupling the electrical wire with the feed thru body. The contact spring may be coupled to the feed thru body. The feed thru body may have a hollow thru bore adapted for containing a booster and the detonator adjacent to each other. The means for electrically coupling the electrical wire with the feed thru body may be a radial wire groove on the feed thru body that an exposed end of the wire wraps around. The means for electrically coupling the electrical wire with the feed thru body may be a tangential thru hole that an exposed end of the wire is wrapped through and around. The means for electrically coupling the electrical wire with the feed thru body may be a metal screw that clamps an exposed end of the wire against a metal insert that is further coupled to the contact spring. The perforating gun string may include a second perforating gun having an uphole box end, a downhole box end, a plurality of shaped charges connected together with a second detonating cord, and a second wire disposed therein, traveling from the uphole end to the downhole end. It may include a second tandem sub coupled to the downhole end of the second perforating gun, the second tandem sub further comprising a cylindrical body with a first end, a second end, and a hollow inner bore, wherein the first end is a pinned end adapted to couple to the box end of the second perforating gun housing, wherein the second end is a pinned end adapted to couple to a box end of a third perforating gun housing, and wherein the inner bore is adapted to contain a plug and play cartridge detonator assembly that can detonate a detonating cord upon receiving an electrical command from the second wire.

An example embodiment may include a method for detonating a perforating gun including coupling a first perforating gun to a tandem sub, wherein the tandem sub contains a plug and play cartridge detonator, connecting a signal wire from the first perforating gun to the tandem sub, placing the first perforating gun at a predetermined location downhole to perforate a desired location of a wellbore, detonating the first perforating gun by sending a firing command to the tandem sub, and removing the first perforating gun from the wellbore.

It may include coupling a second perforating gun to the tandem sub. It may include coupling a second tandem sub to the second perforating gun and connecting a second signal wire from the second perforating gun to the second tandem sub. It may include placing the second perforating gun at a second predetermined location downhole in the wellbore. It may include detonating the second perforating gun by sending a firing command to the second tandem sub.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1A:
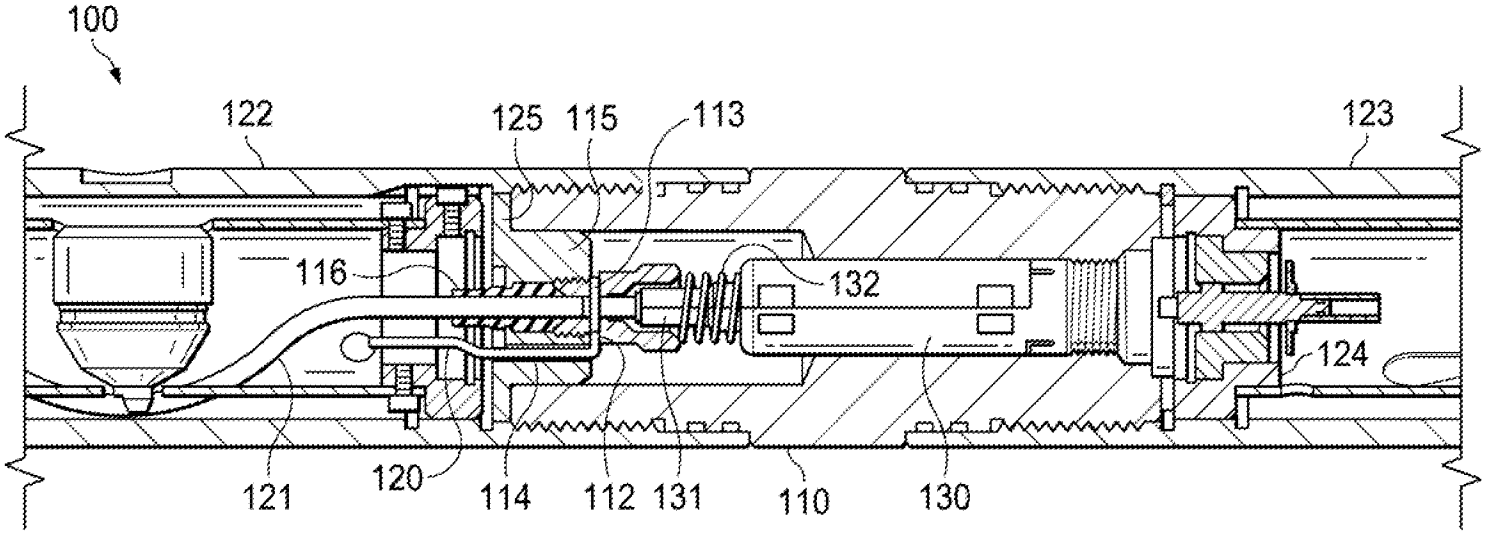
FIG. 1A shows an example embodiment of a side view cross-section of a universal tandem adaptor with a cartridge based ignition system coupled between two perforating gun assemblies.
Figure 1B:
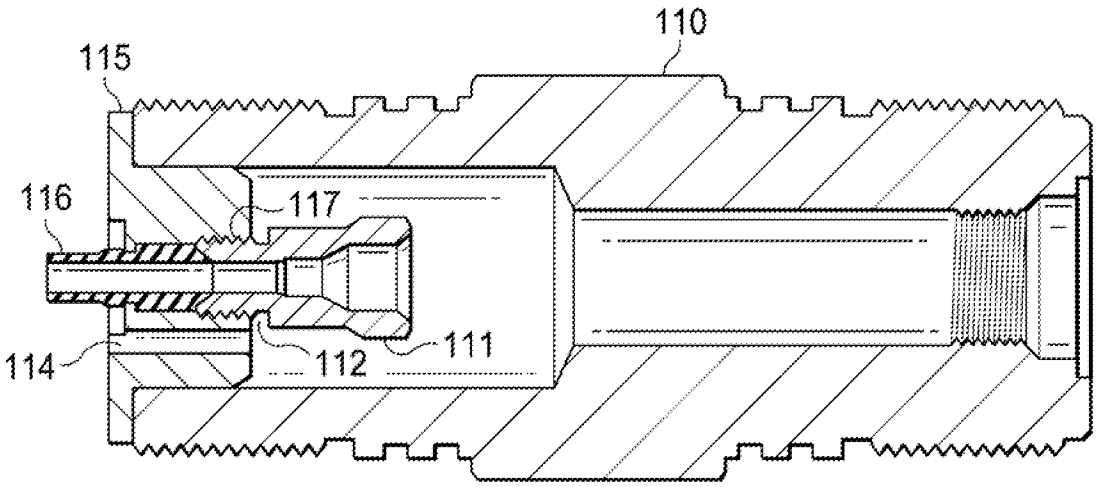
FIG. 1B shows an example embodiment of a side view cross-section of a universal tandem adaptor with a cartridge based ignition system.

An example embodiment is shown in FIGS. 1A and 1B of an assembly 100 including a first perforating gun assembly 122 and a second perforating gun assembly 123 coupled together via tandem sub 110. The first perforating gun assembly 122 and the second perforating gun assembly 123 in this example are box-by-box ends, meaning that both connection ends of each assembly have female threaded connections.

The first perforating gun assembly 122 includes a detonating cord 121 coupled to shaped charges and a pass thru electrical wire 120. The second perforating gun assembly 123 includes a feed thru assembly 124 coupled to the charge tube and in proximate contact with the tandem sub 110.

Tandem sub 110 has a pin-by-pin connection, meaning it has male threads on both connection ends. The tandem sub 110 includes an inner bore containing a cartridge detonator assembly 130 disposed therein. The cartridge detonator assembly 130 includes the detonator 131 disposed within the contact spring 132. The distal end of the detonator 131 is located within the feed thru body 111. The feed thru body 111 is threaded into and engaged with the feed thru puck body 115. The feed thru body 111 includes a radial wire groove 112 where the exposed end 113 of wire 120 wraps around. The wire 120 is fed through the puck body 115 via wire thru hole 114. As the feed thru body 111 is threaded into the puck body 115 the exposed end of the wire is caught and secured. Detonating cord retention grommet 116 is coupled to the booster on the end of detonating cord 121 and disposed within the feed thru puck body 115 and located proximate to the feed thru body 111. The puck body 115 may include a keyed broach 125 for aligning the puck body 115 correctly with the adjacent end fitting coupled to the charge tube of the gun assembly 122.

Figure 2:
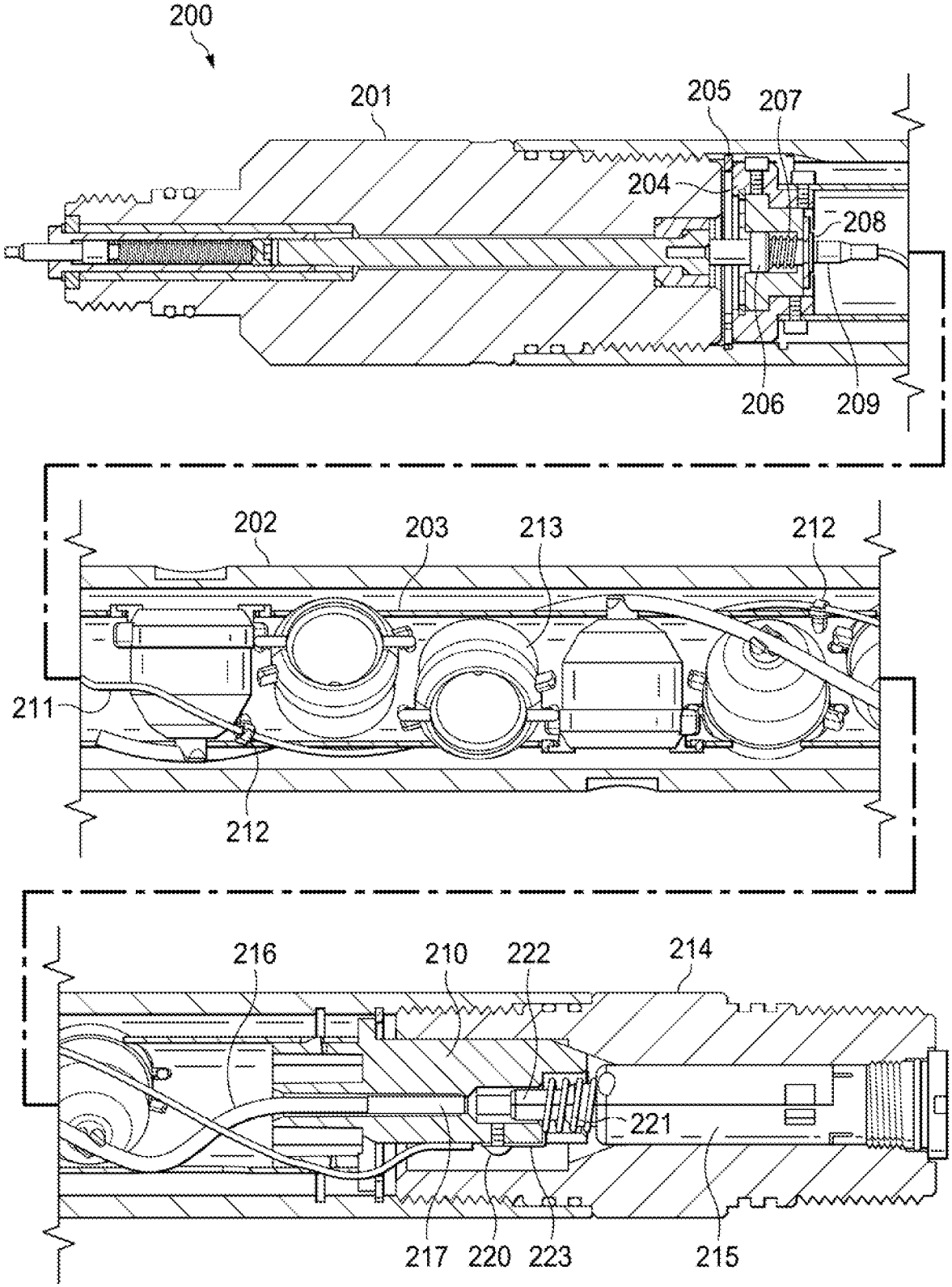
FIG. 2 shows an example embodiment of a side view cross-section of a universal tandem adaptor with a cartridge based ignition system coupled between two perforating gun assemblies.

An example embodiment is shown in FIG. 2 of an assembly 200. Top sub 201 is coupled to a perforating gun 202 having box-by-box connections. A top end fitting 204 is coupled to the uphole end of charge tube 203 and is held in place with snap ring 205. A contact pin 206 and compression spring 207 are disposed within the top end fitting 204. Retainer ring 208 holds the wire tube 209 in place and the wire tube 209 couples the wire 211 to the contact pin 206. Wire 211 is held in place within the charge tube 203 by one or more wire clips 212. A detonating cord 216 is located within the charge tube 203, it is connected to the end of each shaped charge 213 and is further coupled to a booster 217 that is disposed within the bottom end fitting 210. The wire 211 passes through the bottom end fitting and is then electrically terminated at screw 220 against contact insert 223. Contact insert 223 is in electrically contact with contact spring 221, which is in electrical contact with the cartridge detonator assembly 215. Cartridge detonator assembly 215 is disposed within a hollow bore of tandem sub 214 and includes a distal end having a detonator 222 located proximately to the booster 217 enabling the cartridge detonator assembly 215 to ignite the detonating cord 216 and thus fire the shaped charges 213 upon an appropriate electrical signal via wire 211.

Figure 3:
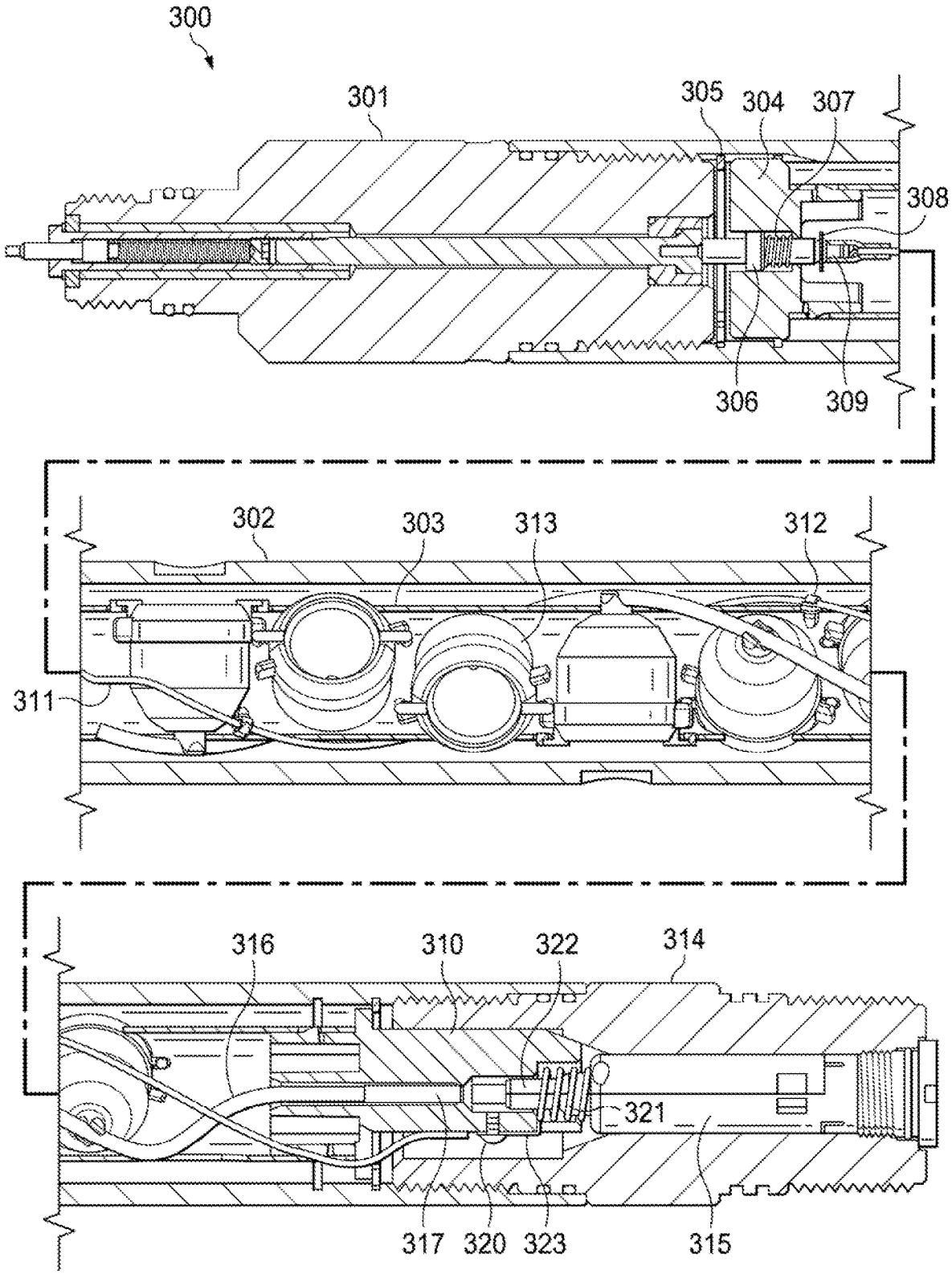
FIG. 3 shows an example embodiment of a side view cross-section of a universal tandem adaptor with a cartridge based ignition system coupled between two perforating gun assemblies.
Figure 4:
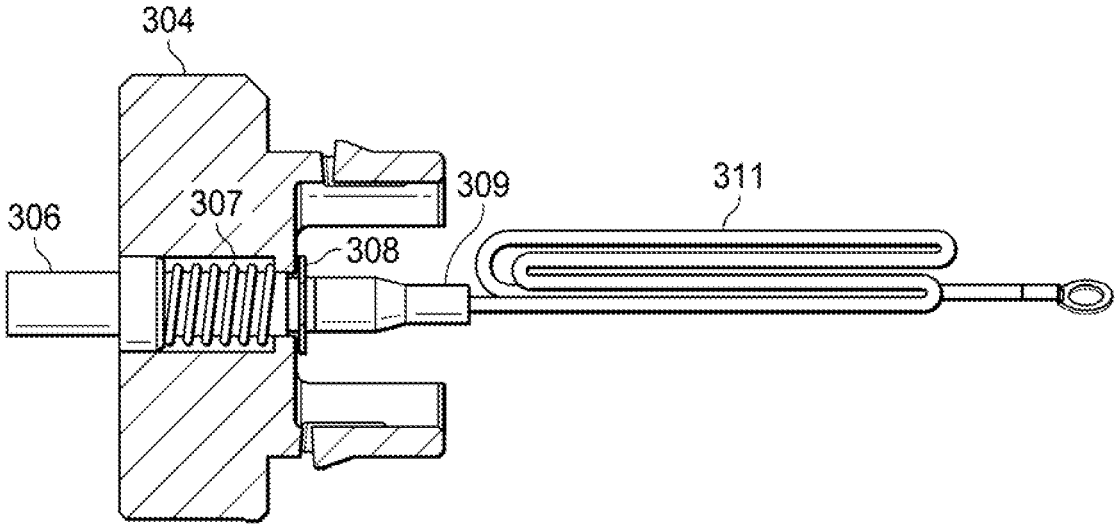
FIG. 4 shows an example embodiment of a side view cross-section of a top end fitting.

An example embodiment is shown in FIGS. 3 and 4 of an assembly 300. Top sub 301 is coupled to a perforating gun 302 having box-by-box connections. A top end fitting 304 is coupled to the uphole end of charge tube 303 and is held in place with snap ring 305. A contact pin 306 and compression spring 307 are disposed within the top end fitting 304. Retainer ring 308 holds the wire tube 309 in place and the wire tube 309 couples with the wire 311 to the contact pin 306. Wire 311 is held in place within the charge tube 303 by one or more wire clips 312. A detonating cord 316 is located within the charge tube 303, it is connected to the end of each shaped charge 313 and is further coupled to a booster 317 that is disposed within the bottom end fitting 310. The wire 311 passes through the bottom end fitting 310 and is then electrically terminated at screw 320 against contact insert 323. Contact insert 323 is in electrically contact with contact spring 321, which is in electrical contact with the cartridge detonator assembly 315. Cartridge detonator assembly 315 is disposed within a hollow bore of tandem sub 314 and includes a distal end having a detonator 322 located proximately to the booster 317 enabling the cartridge detonator assembly 315 to ignite the detonating cord 316 and thus fire the shaped charges 313 upon an appropriate electrical signal via wire 311.

Figure 6:
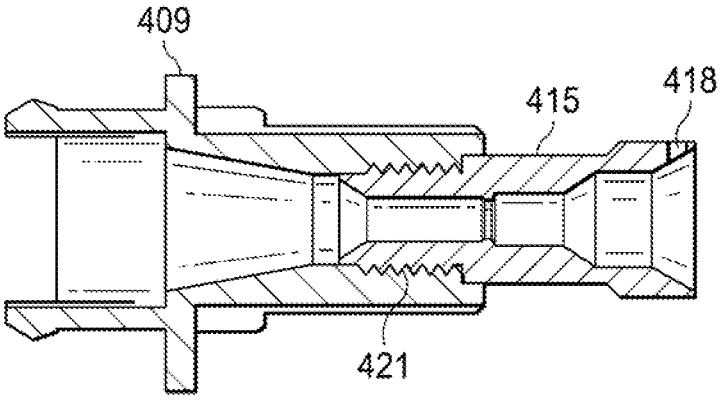
FIG. 6 shows an example embodiment of a side view cross-section of a feed thru puck assembly.
Figure 5:
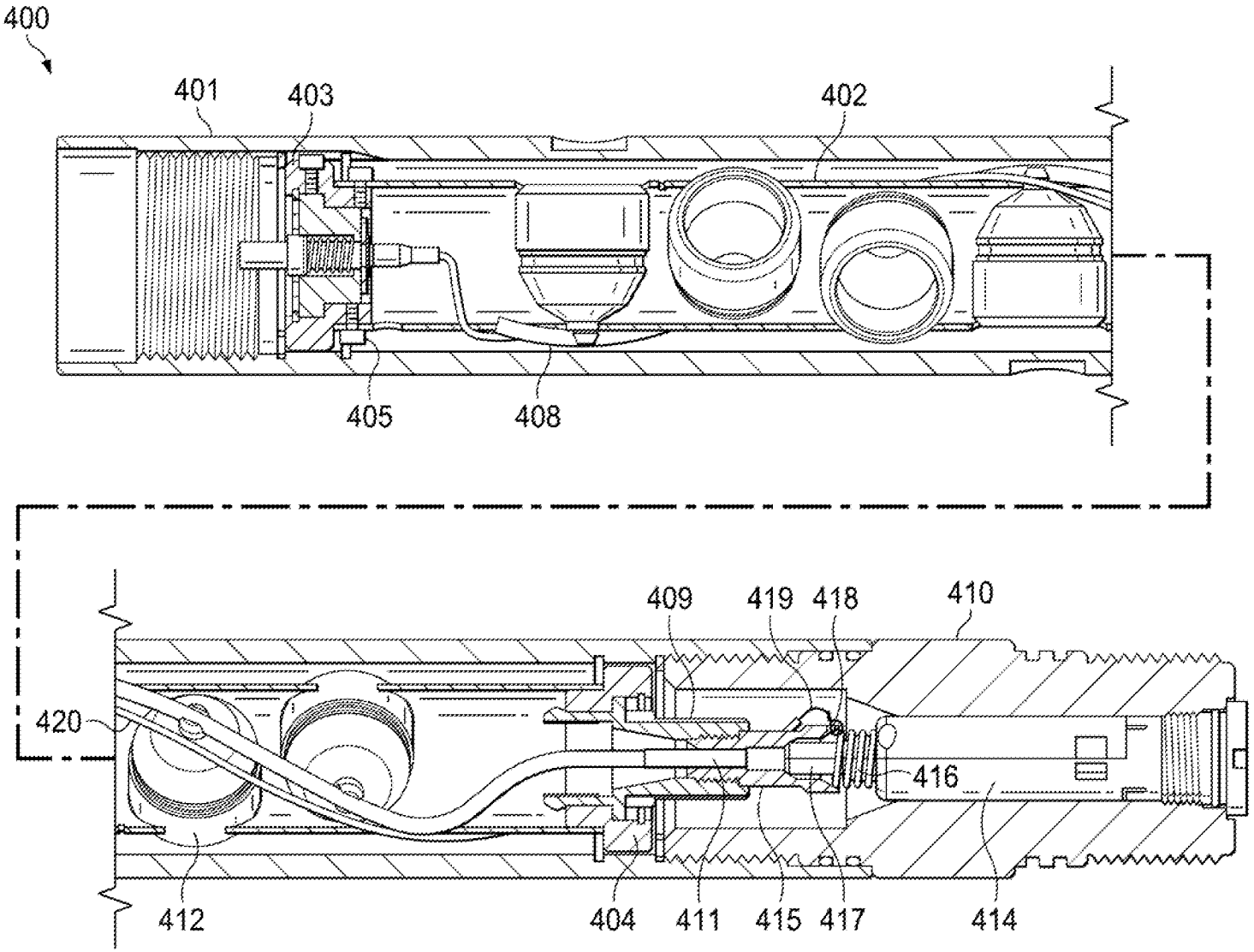
FIG. 5 shows an example embodiment of a side view cross-section of a universal tandem adaptor with a cartridge based ignition system coupled between two perforating gun assemblies.

An example embodiment is shown in FIGS. 5 and 6 of an assembly 400. A perforating gun 401 having box-by-box connections contains a charge tube 402 containing a plurality of shaped charges 412 connected by a detonating cord 408. A top end fitting 403 is coupled to the top end of the charge tube 402 via screw 405. A wire 420 connected to top end fitting 403 extends the length of the perforating gun 401, passes through the bottom end fitting 404, and has an exposed end 419 that is coupled to a feed thru body 415. Feed thru body 415 is threaded, via threads 421 in FIG. 6, into feed thru puck 409. Feed thru puck 409 is coupled with the bottom end fitting 404. The detonating cord 408 is coupled to a booster 411. The booster 411 is disposed within the feed thru body 415. A detonator 417 is partially disposed within the feed thru body 415 such that the detonator 417 is located proximate to the booster 411. The exposed striped wire 419 is wrapped through, and coupled with, a thru hole 418. The wire 420, the feed thru body 415, and the contact spring 416 are in electrical contact with the cartridge detonator assembly 414. The cartridge detonator assembly 414 is disposed within the tandem 410.

Terms such as booster may include a small metal tube containing secondary high explosives that are crimped onto the end of detonating cord. The explosive component is designed to provide reliable detonation transfer between perforating guns or other explosive devices, and often serves as an auxiliary explosive charge to ensure detonation.

Detonating cord is a cord containing high-explosive material sheathed in a flexible outer case, which is used to connect the detonator to the main high explosive, such as a shaped charge. This provides an extremely rapid initiation sequence that can be used to fire several shaped charges simultaneously.

A detonator or initiation device may include a device containing primary high-explosive material that is used to initiate an explosive sequence, including one or more shaped charges. Two common types may include electrical detonators and percussion detonators. Detonators may be referred to as initiators. Electrical detonators have a fuse material that burns when high voltage is applied to initiate the primary high explosive. Percussion detonators contain abrasive grit and primary high explosive in a sealed container that is activated by a firing pin. The impact of the firing pin is sufficient to initiate the ballistic sequence that is then transmitted to the detonating cord.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A tandem sub for connecting one or more perforating guns comprising:

a cylindrical body with a first end, a second end, and a hollow inner bore;

wherein the first end is a pinned end adapted to couple to a box end of a First perforating gun housing;

wherein the second end is a pinned end adapted to couple to a box end of a second perforating gun housing;

wherein the inner bore is adapted to contain a plug and play cartridge detonator assembly that can detonate a detonating cord upon receiving an electrical command from a wire; and a cartridge detonator assembly disposed within the hollow inner bore, the cartridge detonator further comprising a cylindrical body housing, an electrical switch and circuit board, a distal end having a detonator, and a contact spring for electrically coupling the detonator assembly to a signal wire.

2. The tandem sub of claim 1 further comprising a feed thru puck coupled to a feed thru body, disposed within the hollow inner core.

3. The tandem sub of claim 2 wherein the feed thru puck having a thru hole for an electrical wire.

4. The tandem sub of claim 3 wherein the feed thru body having a means for coupling the electrical wire to the puck, thereby electrically coupling the electrical wire with the feed thru body.

5. The tandem sub of claim 4, wherein the contact spring is coupled to the feed thru body.

6. The tandem sub of claim 5, wherein the feed thru body has a hollow thru bore adapted for containing a booster and the detonator adjacent to each other.

7. The tandem sub of claim 4 wherein the means for electrically coupling the electrical wire with the feed thru body is a radial wire groove on the feed thru body that an exposed end of the wire wraps around.

8. The tandem sub of claim 4 wherein the means for electrically coupling the electrical wire with the feed thru body is a tangential thru hole that an exposed end of the wire wraps through and around.

9. The tandem sub of claim 4 wherein the means for electrically coupling the electrical wire with the feed thru body is a metal screw that clamps an exposed end of the wire against a metal insert that is further coupled to the contact spring.

10. A perforating gun string comprising:

a first perforating gun with an uphole box end, a downhole box end, a plurality of shaped charges connected together with a detonating cord, and a wire disposed therein, traveling from the uphole end to the downhole end;

a first tandem sub for connecting one or more perforating guns coupled to the downhole end of the first perforating gun further comprising:

a cylindrical body with a first end, a second end, and a hollow inner bore;

wherein the first end is a pinned end adapted to couple to a box end of the first perforating gun housing;

wherein the second end is a pinned end adapted to couple to a box end of a second perforating gun housing;

wherein the inner bore is adapted to contain a plug and play cartridge detonator assembly that can detonate the detonating cord of the first perforating gun upon receiving an electrical command from the wire; and a cartridge detonator assembly disposed within the hollow inner bore, the cartridge detonator further comprising a cylindrical body housing, an electrical switch and circuit board, a distal end having a detonator, and a contact spring for electrically coupling the detonator assembly to a signal wire.

11. The tandem sub of claim 10 further comprising a feed thru puck coupled to a feed thru body, disposed within the hollow inner core.

12. The tandem sub of claim 11 wherein the feed thru puck having a thru hole for an electrical wire.

13. The tandem sub of claim 12 wherein the feed thru body having a means for coupling the electrical wire to the puck, thereby electrically coupling the electrical wire with the feed thru body.

14. The tandem sub of claim 13, wherein the contact spring is coupled to the feed thru body.

15. The tandem sub of claim 14, wherein the feed thru body has a hollow thru bore adapted for containing a booster and the detonator adjacent to each other.

16. The tandem sub of claim 13 wherein the means for electrically coupling the electrical wire with the feed thru body is a radial wire groove on the feed thru body that an exposed end of the wire wraps around.

17. The tandem sub of claim 13 wherein the means for electrically coupling the electrical wire with the feed thru body is a tangential thru hole that an exposed end of the wire wraps through and around.

18. The tandem sub of claim 13 wherein the means for electrically coupling the electrical wire with the feed thru body is a metal screw that clamps an exposed end of the wire against a metal insert that is further coupled to the contact spring.

19. The perforating gun string of claim 10 further comprising a second perforating gun an uphole box end, a downhole box end, a plurality of shaped charges connected together with a second detonating cord, and a second wire disposed therein, traveling from the uphole end to the downhole end.

20. The perforating gun string of claim 19 further comprising a second tandem sub coupled to the downhole end of the second perforating gun, the second tandem sub further comprising:

a cylindrical body with a first end, a second end, and a hollow inner bore;

wherein the first end is a pinned end adapted to couple to the box end of the second perforating gun housing;

wherein the second end is a pinned end adapted to couple to a box end of a third perforating gun housing; and wherein the inner bore is adapted to contain a plug and play cartridge detonator assembly that can detonate a detonating cord upon receiving an electrical command from the second wire.

21. A method for detonating a perforating gun comprising:

coupling a first perforating gun to a tandem sub, wherein the tandem sub contains a plug and play cartridge detonator;

connecting a signal wire from the first perforating gun to the tandem sub;

placing the first perforating gun at a predetermined location downhole to perforate a desired location of a wellbore;

detonating the first perforating gun by sending a firing command to the tandem sub; and removing the first perforating gun from the wellbore.

22. The method of claim 21 further comprising coupling a second perforating gun to the tandem sub.

23. The method of claim 22 further comprising coupling a second tandem sub to the second perforating gun and connecting a second signal wire from the second perforating gun to the second tandem sub.

24. The method of claim 23 further comprising placing the second perforating gun at a second predetermined location downhole in the wellbore.

25. The method of claim 24 further comprising detonating the second perforating gun by sending a firing command to the second tandem sub.

* * * * *